US005330811A

United States Patent [19]

Buchalter

[11] Patent Number: 5,330,811

[45] Date of Patent: Jul. 19, 1994

[54] DISPOSABLE LAMINATE DRAIN COVER

[76] Inventor: Mark R. Buchalter, 3326 Farragut St., Hollywood, Fla. 33021

[21] Appl. No.: 537,256

[22] Filed: Jun. 13, 1990

[51] Int. Cl.[5] ..... A47K 1/06

[52] U.S. Cl. ..... 428/40; 4/580; 4/583; 4/650; 4/652; 4/653; 4/655; 428/65; 428/136; 428/137; 428/138; 428/344; 428/354; 428/457

[58] Field of Search ..... 428/40, 65, 136, 63, 428/137, 138, 308, 344, 354, 457; 4/650, 652, 653, 655, DIG. 18, 191, 661, 580, 583; 156/94; 210/163; 52/514; 312/229; D23/261, 284; D32/57

[56] References Cited

U.S. PATENT DOCUMENTS

| | | | |
|---|---|---|---|
| 1,992,008 | 2/1935 | Innis | 4/580 |
| 2,319,603 | 5/1943 | Henry | 4/580 |
| 2,692,425 | 10/1954 | Martin | 156/94 |
| 2,760,728 | 8/1956 | Jordan | 4/654 |
| 2,804,416 | 8/1957 | Phillipsen | 428/344 |
| 2,817,851 | 12/1957 | Barnwell | 4/DIG. 18 |
| 2,859,875 | 11/1958 | Wilkie | 210/163 |
| 3,024,471 | 3/1962 | Anderson | 4/DIG. 18 |
| 3,300,790 | 1/1967 | Foote | 4/580 |
| 4,500,580 | 2/1985 | Luciani | 428/43 |
| 4,655,913 | 4/1987 | Boersma | 210/163 |
| 5,055,343 | 10/1991 | Murphy | 428/344 |

FOREIGN PATENT DOCUMENTS

| | | | |
|---|---|---|---|
| 10386 | 1/1979 | Japan | 4/580 |

*Primary Examiner*—Ellis P. Robinson
*Assistant Examiner*—Nasser Ahmad
*Attorney, Agent, or Firm*—Evelyn M. Sommer

[57] ABSTRACT

A laminate cover member is provided for upgrading the appearance of a deteriorated drain hole or other surface of a sink or bath fixture. The cover member includes an upper layer which is resistant to corrosion and has an attractive visual appearance, a pressure sensitive adhesive layer, and a removable liner layer. The layers are diecut from stock laminate sheets. A preferred cover member, for upgrading the surfaces of a drain hole, has a metallized plastic upper layer, and is shaped with an outer annular portion that is adhered to the surface surrounding the drain hole, an inner annular hole, and a plurality of radial lines extending from an intermediate diameter to the inner annular hole, such that they can be bent downwardly to cover an inner part of the drain hole surface.

4 Claims, 1 Drawing Sheet

DISPOSABLE LAMINATE DRAIN COVER

FIELD OF THE INVENTION

This invention generally relates to a laminate article, and more particularly, to one which has utility as a disposable drain cover.

BACKGROUND ART

As bathroom and kitchen fixtures age, they often take on an unattractive appearance as metal surfaces corrode and ceramic surfaces discolor or become scratched or pitted. In particular, the metal or ceramic surface surrounding a drain hole of an aged fixture can become visibly deteriorated and unattractive even though the fixture as a whole can still be used or may have value as an antique or period piece.

In order to extend the useful life of such fixtures, it is highly desirable to have an inexpensive and convenient means of restoring the appearance of the deteriorated surfaces without having to engage in wholesale restoration or replacement of parts which may be out of production or no longer available.

SUMMARY OF THE INVENTION

In accordance with the invention, a laminate article for upgrading the appearance of a deteriorated surface of a fixture comprises a cover member having a shape corresponding to the surface to be upgraded, said cover member including a corrosion-resistant upper layer having an attractive visual appearance, a pressure sensitive adhesive layer for adhering onto the surface to be upgraded, and a removable liner layer for covering the adhesive layer prior to installation of the cover member on the deteriorated surface.

In a preferred embodiment, the cover member is designed to cover a circular drain hole of a fixture. The upper layer may be a metallized layer with a protective film, or may be a colored plastic layer for a decorative appearance. The upper, adhesive, and liner layers are diecut together in the shape of an outer annular portion having an outer diameter which is adhered over an outer annular surface surrounding the drain hole, an inner annular hole having an inner diameter, and a plurality of symmetrically-spaced radial lines extending from an intermediate diameter between said outer and inner diameters to said inner annular hole. The radial lines define a plurality of wedge-shaped sectors which are bendable downwardly into the drain hole to cover an inner part of the drain hole surface.

Other objects, features, and advantages of the present invention will become apparent from the following detailed description of the best mode of practising the invention when considered in conjunction with the drawings, as follows:

DESCRIPTION OF THE PREFERRED EMBODIMENTS

Figure 1:
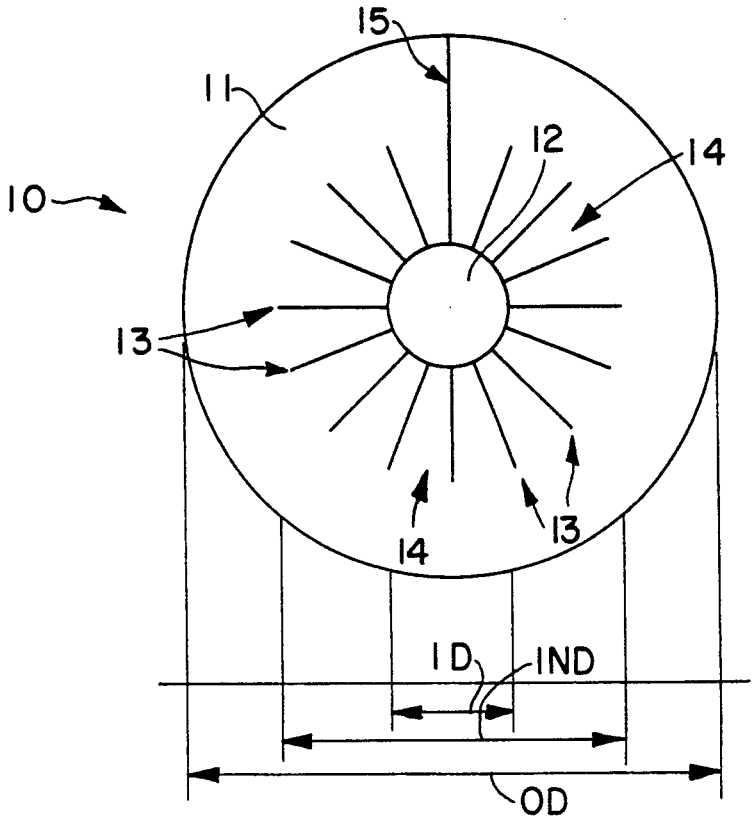
FIG. 1 is a schematic plan view of a preferred embodiment of a laminate cover member in accordance with the invention.

Referring to FIG. 1, a laminate article for upgrading the appearance of a deteriorated surface of a fixture is embodied as a cover member 10 having a shape corresponding to the surface to be upgraded. In the preferred embodiment, the cover member is designed to upgrade a drain hole of a sink, bathtub or bath fixture. The cover member includes upper, adhesive, and liner layers (described further below) which are diecut together to have an outer annular portion 11 having an outer diameter OD which is adhered over an outer annular surface surrounding the drain hole, an inner annular hole 12 having an inner diameter ID, and a plurality of lines 13 extending from an intermediate diameter IND between the outer and inner diameters to the inner annular hole 12.

In the preferred embodiment, the upper layer may be a metallized layer with a protective film, or may be a colored plastic layer for a decorative appearance. The radial lines 13 are preferably symmetrically spaced and define a plurality of wedge-shaped sectors 14 which are bendable downwardly into the drain hole to cover an inner part of the drain hole surface. The inner diameter of the drain hole can be anywhere in the range from the intermediate diameter IND to the inner diameter ID of the cover member. A full separation line 15 extending from outer to inner diameter is optionally provided to accomodate installation over slightly convex or concave drain surfaces. Alternatively, the cover member may be installed around a pipe connected to the fixture using the separation line 15.

Figure 2:
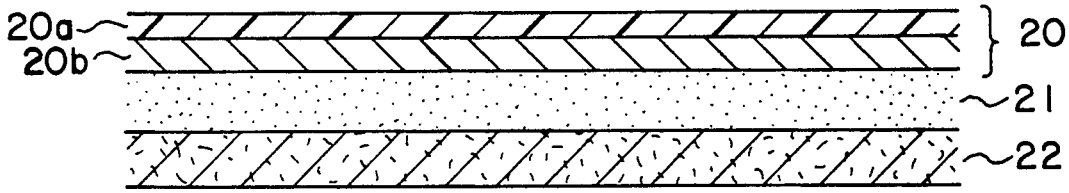
FIG. 2 is a side sectional view of the laminate layers of the cover member of the invention.

Referring to FIG. 2, the laminate structure of the cover member includes a upper layer 20, which is fabricated to be resistant to corrosion and has an attractive visual appearance, a pressure sensitive adhesive layer 21, for adhering onto the surface to be upgraded, and a removable liner layer 22 for covering the adhesive layer prior to installation of the cover member on the deteriorated surface. On installation, the liner layer is peeled off from the adhesive layer, and the adhesive layer is pressed into adhesion with the surface to be covered.

The upper layer 20 preferably is formed with an outer plastic film layer **20*a*, e.g. of vinyl or as used in Mylar, and an inner metal or metallized layer 20*b*, such as aluminum foil. Pressure-sensitive laminate sheets can be obtained, for example, from Flexcon Company, Inc., under the designation Flexmark, having 2.0 mm thickness (MM200), silver color, pressure-sensitive adhesive (V-23), and liner (90 PFW). The stock sheets are diecut to have the desired form corresponding to the type of fixture to be covered. On installation, the inner diecut portion is omitted to provide the inner annular hole 12. For typical drain holes, e.g. of 0.75 inch diameter, the cover member as shown in FIG. 1** can have an inner diameter of about 0.625 inch, an outer diameter of about 2.85 inches, and in intermediate diameter of about 1.215 for the radial slits.

The cover member also has the advantage that it can be readily removed by peeling off from the fixture surface and discarded when it is desirable to replace it with a new cover member or one of a different color or visual appearance. This provides a new consumer capability of being able to change or improve the appearance of existing fixtures without the cost and time of replacing them.

Numerous modifications and variations are of course possible in light of the principles of the invention disclosed above. All such modifications and variations are intended to be included within the spirit and scope of the invention, as defined in the following claims.

I claim:

1. A laminate article for upgrading the appearance of a deteriorated surface around an annular hole of a drain fixture, comprising:

a cover member having a shape corresponding to the surface to be upgraded, said cover member including an upper layer which is resistant to corrosion and has an attractive visual appearance, a pressure sensitive adhesive layer for adhering onto the surface to be upgraded, and a removable liner layer for covering the adhesive layer prior to installation of the cover member on the deteriorated surface, wherein said cover member is a pressure-sensitive laminate sheet which can be disposably applied to the deteriorated surface around the annular drain hole, said laminate sheet having said upper, adhesive, and liner layers diecut together to form the laminate article with an outer annular portion having an outer diameter, an inner annular hole having an inner diameter, and a plurality of radial lines extending from an intermediate diameter between said outer and inner diameters to said inner annular hole, whereby said cover member can be applied around drain holes of inner diameters anywhere in the range from said intermediate diameter to said inner diameter of said cover member.

2. A laminate article according to claim 1, wherein said cover member is designed to cover a drain hole having an outer drain surface and an inner drain hole surface, and wherein said outer annular portion of said cover member is adhered over the outer annular surface surrounding the drain hole, and said radial lines are symmetrically-spaced and define a plurality of wedge-shaped sectors which are bendable downwardly into the drain hole to cover the inner drain hole surface.

3. A laminate article according to claim 1, wherein said cover member includes a diecut separation line extending from said outer diameter to said inner diameter, whereby installation around a pipe connected to the fixture or a convex or concave drain surfaces is facilitated.

4. A laminate article according to claim 1, wherein said upper layer is made of an outer plastic film layer and an inner metal or metallized layer.

* * * * *